US005664552A

United States Patent [19]

Kunimoto

[11] Patent Number: 5,664,552

[45] Date of Patent: Sep. 9, 1997

[54] GAS PRESSURE ACCUMULATING AND SUPPLYING DEVICE FOR USE IN MODEL GUNS

[75] Inventor: Keiichi Kunimoto, Tokyo, Japan

[73] Assignee: Western Arms, Tokyo, Japan

[21] Appl. No.: 623,127

[22] Filed: Mar. 28, 1996

[30] Foreign Application Priority Data

Apr. 5, 1995 [JP] Japan ..... 7-080143

[51] Int. Cl.[6] ..... F41B 11/00

[52] U.S. Cl. ..... 124/73; 124/76

[58] Field of Search ..... 124/56, 70, 73, 124/74, 76

[56] References Cited

U.S. PATENT DOCUMENTS

| | | | |
|---|---|---|---|
| 1,516,483 | 11/1924 | Krafft | 124/70 X |
| 2,566,181 | 8/1951 | Fitch | 124/70 X |
| 2,818,056 | 12/1957 | Martin | 124/76 X |
| 5,462,042 | 10/1995 | Greenwell | 124/73 X |
| 5,476,087 | 12/1995 | Kunimoto | 124/73 |
| 5,477,843 | 12/1995 | Kunimoto | 124/73 |
| 5,497,758 | 3/1996 | Dobbins et al. | 124/73 |

FOREIGN PATENT DOCUMENTS 90195 12/1993 Japan .

*Primary Examiner*—John A. Ricci

*Attorney, Agent, or Firm*—Sixbey, Friedman, Leedom & Ferguson, P.C.; David S. Safran

[57] ABSTRACT

A gas pressure accumulating and supplying device for use in model guns, which comprises a pressure accumulating chamber provided in a case member, a gas injecting opening provided on a bottom portion of the case member, a gas introducing structure extending from the gas injecting opening into the pressure accumulating chamber, a gas discharging passage extending from the pressure accumulating chamber, and a control valve structure provided in the gas discharging passage for controlling supply of gas pressure from the pressure accumulating chamber. The pressure accumulating chamber is provided therein with a partition member for partitioning the pressure accumulating chamber into a main chamber into which liquefied gas is injected through the gas introducing structure from the gas injecting opening and a subchamber positioned between the main chamber and the gas discharging passage and a gas passage forming portion extending from the partition member into the main chamber for forming a gas passage connecting the main chamber with the subchamber and having an end portion reaching a position the gas introducing structure.

6 Claims, 4 Drawing Sheets

GAS PRESSURE ACCUMULATING AND SUPPLYING DEVICE FOR USE IN MODEL GUNS

BACKGROUND OF THE INVENTION

1. Field of the Invention

The present invention relates generally to a gas pressure accumulating and supplying device for use in model guns, and more particularly, to an improvement in a gas pressure accumulating and supplying device having a case member which can be held detachably in a model gun and in which a pressure accumulating chamber is provided to be partitioned into a main chamber which is charged with liquefied gas injected therein through a gas injection opening and a subchamber connected with a gas discharging passage.

2. Description of the Prior Art

There has been proposed a model gun which is often called an air soft gun and provided therein such an arrangement that gas pressure is used for shooting a sham bullet put in a bullet holding chamber positioned just at the back of a barrel. In the model gun in which the gas pressure is used for shooting the sham bullet, a gas pressure accumulating and supplying block having therein a pressure accumulating chamber which is charged with liquefied gas and a gas passage for supplying a pressure chamber formed in a body of the model gun with gas pressure produced by the liquefied gas in the pressure accumulating chamber, is inserted into a grip provided in the body of the model gun. The gas pressure supplied from the pressure accumulating chamber through the gas pressure to the pressure chamber is caused to act on the sham bullet put in the bullet holding chamber so as to shoot the sham bullet in response to the movement of a trigger provided in the body of the model gun.

It has been also proposed a model gun in which gas pressure is used for supplying a bullet holding chamber provided in a body of the model gun with a sham bullet and further for shooting the sham bullet put in the bullet holding chamber, as shown in, for example, Japanese utility model application published before examination under publication number 5-8252. In the model gun thus proposed, a gas pressure accumulating and supplying block (referred to as "a magazine" in the above mentioned publication) which has a case member in which a pressure accumulating chamber in which liquefied gas is injected through a gas introducing pipe connected with a gas injecting opening, a gas discharging passage extending from the pressure accumulating chamber, a control valve for controlling the gas discharging passage to be open and closed selectively in response to the movements of a trigger, and a magazine portion for containing sham bullets are provided, is held detachably in a grip formed in a body of the model gun. Further, a cylinder chamber in which a piston rod is put is positioned to face to a bullet holding chamber provided in the body of the model gun. The piston in the cylinder chamber is moved by gas pressure supplied from the pressure accumulating chamber through the gas discharging passage made open by the control .valve to the cylinder chamber so as to shoot a sham bullet put in the bullet holding chamber and further to supply the bullet holding chamber from which the sham bullet has been shot with a new sham bullet discharged from the magazine portion, so that a plurality of sham bullets can be continuously shot automatically.

The model gun in which the gas pressure discharged from the pressure accumulating chamber provided in the case member of the gas pressure accumulating and supplying block held in the grip is used for shooting the sham bullet put in the bullet holding chamber and for supplying the bullet holding chamber with the sham bullet, as described above, is handled to cause the gas pressure accumulating and supplying block to assume such a posture that the gas injecting opening is positioned above the pressure accumulating chamber and the gas introducing pipe extends vertically downward from the gas injecting opening when the pressure accumulating chamber provided in the gas pressure accumulating and supplying block is charged with liquefied gas. With this posture of the gas pressure accumulating and supplying block, the liquefied gas injected from the gas injecting opening positioned above the pressure accumulating chamber through the gas introducing pipe into the pressure accumulating chamber can be impounded to have its surface by which the end portion of the gas introducing pipe is closed. That is, the liquefied gas is impounded at its maximum in the pressure accumulating chamber when the end portion of the gas introducing pipe is closed by the surface of the liquefied gas in the pressure accumulating chamber.

As to the model gun in which the pressure accumulating chamber provided in the case member of the gas pressure accumulating and supplying block is thus charged with the liquefied gas, it is desired that gas pressure discharged from the pressure accumulating chamber is kept at such an appropriate value that an automatic operation for shooting a plurality of sham bullets continuously is properly performed over a relatively long period. Therefore, the gas pressure accumulating and supplying block having the case member in which the the pressure accumulating chamber is provided is desired to be maintained in a condition wherein only gas obtained by evaporation of the liquefied gas in the pressure accumulating chamber is supplied through the gas discharging passage to a pressure chamber formed in the body of the model gun whenever the gas discharging passage is made open.

However, when the model gun in which the case member of the gas pressure accumulating and supplying block is held in the grip is actually used, the case member of the gas pressure accumulating and supplying block is caused to assume various postures in accordance with various kinds of handling of the model gun and the liquefied gas in the pressure accumulating chamber provided in the gas pressure accumulating and supplying block moves very actively, so that it is feared that the liquefied gas in the pressure accumulating chamber leaks out frequently to the gas discharging passage. In the case where the gas discharging passage to which a relatively large amount of liquefied gas has been leaked out from the pressure accumulating chamber is made open, the relatively large amount of liquefied gas in the gas discharging passage blows off from the gas pressure accumulating and supplying block into the body of the model gun.

This means that a situation in which the gas pressure accumulating and supplying block is not maintained in the condition wherein only gas obtained by evaporation of the liquefied gas in the pressure accumulating chamber is supplied through the gas discharging passage to the pressure chamber formed in the body of the model gun can arise when the gas discharging passage is made open. In the case where such a situation arises, the liquefied gas impounded in the pressure accumulating chamber is wasted and therefore gas pressure discharged from the pressure accumulating chamber cannot be kept at the appropriate value over a relatively long period after the pressure accumulating chamber is charged at its maximum with the liquefied gas.

OBJECTS AND SUMMARY OF THE INVENTION

Accordingly, it is an object of the present invention to provide a gas pressure accumulating and supplying device for use in model guns, which has a case member provided therein with a pressure accumulating chamber which is charged with liquefied gas injected therein through a gas injection opening, a gas discharging passage connected with the pressure accumulating chamber, and a control valve for controlling the gas discharging passage to be open and closed selectively, and which avoids the aforementioned disadvantages encountered with the prior art.

Another object of the present invention is to provide a gas pressure accumulating and supplying device for use in model guns, which has a case member provided therein with a pressure accumulating chamber which is charged with liquefied gas injected therein through a gas injection opening, a gas discharging passage connected with the pressure accumulating chamber, and a control valve for controlling the gas discharging passage to be open and closed selectively, and in which a condition wherein only gas obtained by evaporation of the liquefied gas in the pressure accumulating chamber is supplied through the gas discharging passage to a pressure chamber formed in a model gun whenever the gas discharging passage is made open by the control valve can be maintained even under a situation wherein the case member is held detachably in a grip of the model gun and caused to assume various postures in accordance with various kinds of handling of the model gun.

A further object of the present invention is to provide a gas pressure accumulating and supplying device for use in model guns, which has a case member provided therein with a pressure accumulating chamber which is charged with liquefied gas injected therein through a gas injection opening, a gas discharging passage connected with the pressure accumulating chamber, and a control valve for controlling the gas discharging passage to be open and closed selectively, and in which a condition wherein the liquefied gas injected into the pressure accumulating chamber through the gas injection opening leaks out to the gas discharging passage is surely prevented from arising with a relatively simple construction even under a situation wherein the case member is held detachably in a grip of the model gun and caused to assume various postures in accordance with various kinds of handling of the model gun.

A still further object of the present invention is to provide a gas pressure accumulating and supplying device for use in model guns, which has a case member provided therein with a pressure accumulating chamber which is charged with liquefied gas injected therein through a gas injection opening, a gas discharging passage connected with the pressure accumulating chamber, and a control valve for controlling the gas discharging passage to be open and closed selectively, and by which the liquefied gas injected into the pressure accumulating chamber through the gas injection opening is surely prevented from being wasted so that consumption of the liquefied gas can be reduced effectively after the pressure accumulating chamber is charged at its maximum with the liquefied gas.

According to the present invention, there is provided a gas pressure accumulating and supplying device for use in model guns, which comprises a pressure accumulating chamber provided in a case member, a gas injecting opening provided on a bottom of the case member, a gas introducing structure extending from the gas injecting opening into the pressure accumulating chamber, a gas discharging passage facing to the bottom of the case member with the pressure accumulating chamber between, a control valve structure provided in the gas discharging passage for controlling supply of gas pressure from the pressure accumulating chamber, a partition member provided in the pressure accumulating chamber for partitioning the pressure accumulating chamber into a main chamber into which liquefied gas is injected through the gas introducing structure from the gas injecting opening and a subchamber positioned between the main chamber and the gas discharging passage, and a gas passage forming portion extending from the partition member into the main chamber for forming a gas passage connecting the main chamber with the subchamber and having an end portion reaching a position closer to the bottom of the case member than an end portion of the gas introducing structure.

In the gas pressure accumulating and supplying device thus constituted in accordance with the present invention, the gas passage forming portion which extends into the main chamber to have the end portion thereof reaching the position closer to the bottom of the case member than the end portion of the gas introducing structure which extends from the gas injecting opening into the pressure accumulating chamber is provided on the partition member which partitions the pressure accumulating chamber into the main chamber and the subchamber and is operative to prevent the liquefied gas from flowing from the main chamber into the subchamber regardless of posture of the case member. The gas passage forming portion extends upward from the partition member which is positioned below the gas introducing structure for forming a bottom of a liquefied gas storing portion to have the end portion thereof positioned higher than the end portion of the gas introducing structure when the case member is caused to assume such a posture that the gas injecting opening is positioned above the main chamber and the liquefied gas is injected into the main chamber through the gas introducing structure from the gas injecting opening. With this arrangement, the end portion of the gas passage forming portion does not come into contact with the liquefied gas in the main chamber and the gas passage forming portion is operative to introduce only gas obtained by evaporation of the liquefied gas in the main chamber into the subchamber even under a condition wherein the liquefied gas injected into the main chamber through the gas introducing passage from the gas injecting opening is impounded at its maximum in the liquefied gas storing portion having the bottom formed with the partition member so as to close the end portion of the gas introducing structure.

The gas passage forming portion having the end portion thereof which does not come into contact with the liquefied gas impounded at its maximum in the liquefied gas storing portion having the bottom formed with the partition member, as mentioned above, is operative to prevent the liquefied gas impounded in the liquefied gas storing portion, which is formed in the main chamber in response to the posture of the case member, from flowing to move from the main chamber to the subchamber and to introduce only gas obtained by evaporation of the liquefied gas in the main chamber into the subchamber also when the case member is caused to assume any posture other than the posture by which the gas injecting opening is positioned above the main chamber. With the gas passage forming portion thus provided to extend from the partition member which prevents the liquefied gas injected into the main chamber from flowing into the subchamber for introducing only gas obtained by evaporation of the liquefied gas in the main chamber into the subchamber regardless of the posture of the case member, a condition wherein the liquefied gas impounded in the main chamber leaks out to the gas discharging passage connected with the subchamber is surely prevented from arising.

Accordingly, in the gas pressure accumulating and supplying device according to the present invention, a condition wherein the liquefied gas injected into the main chamber provided in the pressure accumulating chamber through the gas introducing structure from the gas injection opening leaks out through the subchamber provided in the pressure accumulating chamber to the gas discharging passage is surely prevented from arising with the partition member which is provided for preventing the liquefied gas injected into the main chamber from flowing into the subchamber with a relatively simple construction including the gas passage forming portion even under a situation wherein the case member is held detachably in the grip of the model gun and caused to assume various postures in accordance with various kinds of handling of the model gun. Therefore, a condition in which only gas obtained by evaporation of the liquefied gas in the pressure accumulating chamber is supplied through the gas discharging passage to the body of the model gun whenever the gas discharging passage is made open is maintained. Consequently, in the model gun to which the gas pressure accumulating and supplying device according to the present invention is applied, gas pressure discharged from the pressure accumulating chamber can be kept at an appropriate value over a relatively long period after the pressure accumulating chamber is charged at its maximum with the liquefied gas.

DESCRIPTION OF THE PREFERRED EMBODIMENTS

Figure 1:
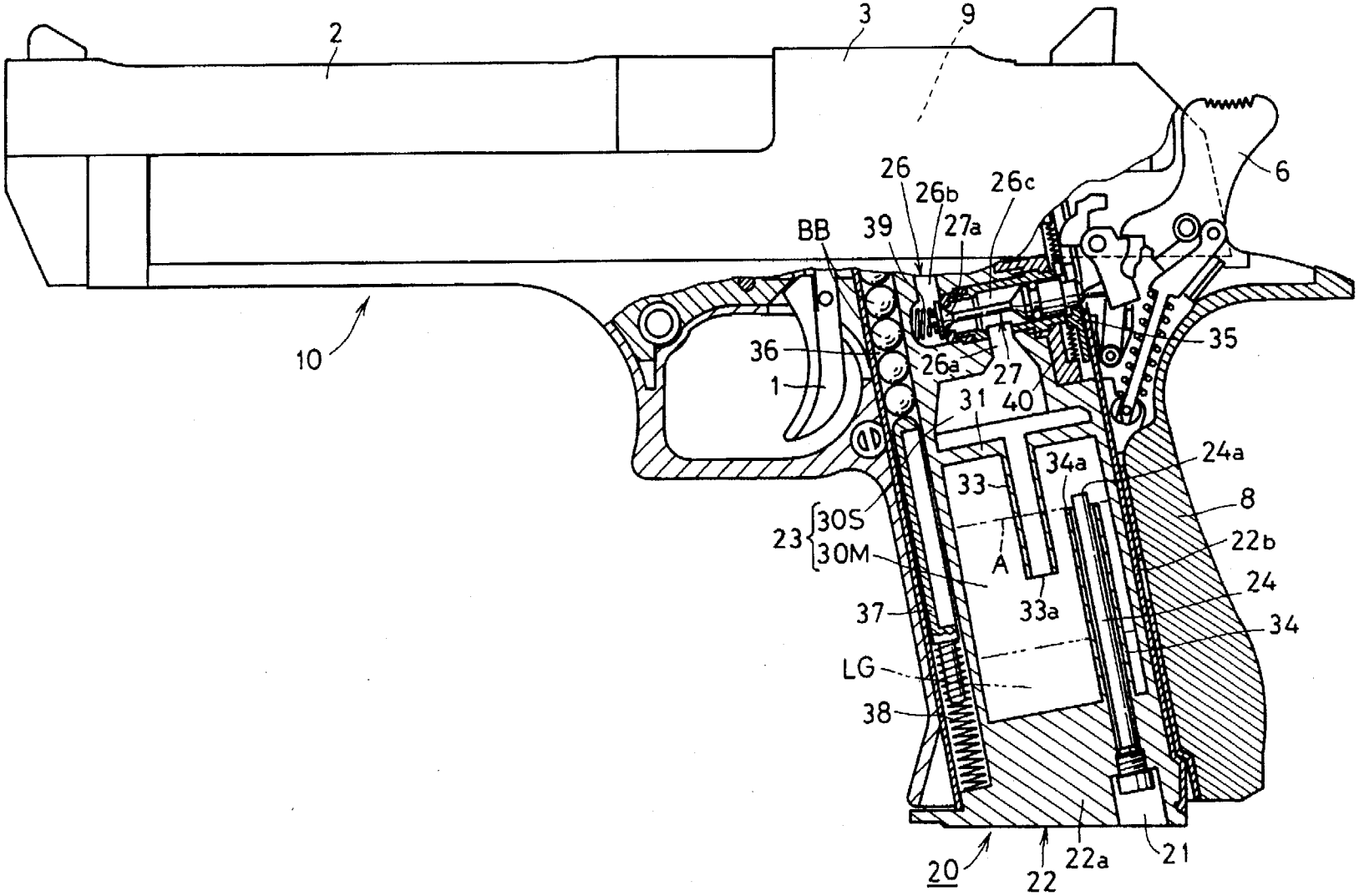
FIG. 1 is a schematic side view including a partial cross sectional view showing an embodiment of gas pressure accumulating and supplying device for use in model guns according to the present invention and a part of a model gun to which the embodiment is applied.

FIG. 1 shows an embodiment of gas pressure accumulating and supplying device for use in model guns according to the present invention and a part of a model gun to which the embodiment is applied.

Referring to FIG. 1, the model gun to which the embodiment is applied has a body 10 in which a trigger 1, a barrel 2, a slider 3 having a front portion extending along the barrel 2 and a rear portion positioned at the back of the barrel 2, a hammer 6 moved to rotate in response to movements of the trigger I and a grip 8 are provided and a gas pressure accumulating and supplying device 20 which is constituted with one of embodiment of gas pressure accumulating and supplying device for use in model guns according to the present invention and held detachably in the grip 8. The body 10 of the model gun is further provided with a bullet holding chamber provided just at the back of the barrel 2 and a movable member which is provided between the bullet holding chamber and the hammer 6 though they are omitted to be shown in FIG. 1. The slider 3 is movable along the barrel 2 and the movable member provided in the body 10 has a pressure chamber 9 and gas controlling structure (not shown in FIG. 1). The gas controlling structure is operative to lead gas pressure to the bullet holding chamber positioned just at the back of the barrel 2 and the pressure chamber 9 formed in the movable member, respectively, in response to the magnitude of the gas pressure acting on the gas controlling structure.

The gas pressure accumulating and supplying device 20 has a case member 22 which comprises a bottom portion **22*a* on which a gas injecting opening 21 is provided and a frame portion 22*b* engaged with the bottom portion 22*a*. The case member 22 of the gas pressure accumulating and supplying device 20 is inserted into the grip 8 through an opening provided at a lower end portion of the grip 8 and the bottom portion 22*a* of the case member 22 is engaged with the lower end portion of the grip 8 so that the case member 22 is held detachably in the grip 8**.

In the case member 22 of the gas pressure accumulating and supplying device 20, a pressure accumulating chamber 23, a gas introducing pipe 24 extending linearly from the gas injecting opening 21 into the pressure accumulating chamber 23, a gas discharging passage 26, opening into the pressure accumulating chamber in a direction toward the bottom portion **22*a* of the case member 22, and a control valve structure 27 provided in the gas discharging passage 26 for controlling supply of gas pressure from the pressure accumulating chamber 23 to the body 10 of the model gun are provided to be surrounded by the frame portion 22*b*. Further, in the case member 22, a partition member 31 is provided in the pressure accumulating chamber 23 for partitioning the pressure accumulating chamber 23 into a main chamber 30M into which liquefied gas, such as flon gas, is injected through the gas introducing pipe 24 from the gas injecting opening 21 and a subchamber 30S positioned between the main chamber 30M and the gas discharging passage 26, and a gas passage forming portion 33 is incorporated with the partition member 31. The control valve structure 27 is moved in accordance with the rotating movement of the hammer 6 provided in the body 10 of the model gun and a lock lever 35 is provided in the vicinity of the gas discharging passage 26 for restraining selectively the movement of the control valve structure 27**.

In addition, the case member 22 of the gas pressure accumulating and supplying device 20 is provided therein with a magazine 36 for containing sham bullets BB, in which a pushing member 37 and a coil spring 38 are provided for pushing the sham bullets BB up toward the upper end portion of the magazine 36.

The gas injecting opening 21 and the gas introducing pipe 24 are so positioned that an imaginary center line common to both of the gas injecting opening 21 and the gas introducing pipe 24 is deviated from an imaginary center line of the main chamber 30M and a tubular member 34 extends from the bottom portion **22*a* of the case member 22 for surrounding the gas introducing pipe 24. The tubular member 34 forms a tubular passage between the outer surface of the gas introducing pipe 24 and the inner surface of the tubular member 34, through which gas leaking from gas wasting holes provided on the gas introducing pipe 24 is leaded to the main chamber 30M. The gas introducing pipe 24 and the tubular member 34 constitute together a gas introducing structure. The gas introducing pipe 24 has an end portion 24*a* thereof which projects from an end portion 34*a* of the tubular member 34 into the main chamber 30M so as to reach closely to the partition member 31**.

The gas passage forming portion 33 extends linearly from the partition member 31 into the main chamber 30M to have an end portion **33*a* thereof reaching more closely to the bottom portion 22*a* of the case member 22 than the end portion 34*a* of the tubular member 34 which constitutes the gas introducing structure and to form a gas passage connecting the main chamber 30M with the subchamber 30S. The main chamber 30M into which the gas passage forming portion 33 extends from the partition member 31 is divided substantially into a first region on the subchamber side close to the subchamber 30S and a second region on the gas injecting opening side close to the bottom portion 22*a* of the case member 22 provided with the gas injecting opening 21 by a plane A which includes the end portion 34*a* of the tubular member 34 and is perpendicular to the imaginary center line of the gas introducing structure constituted with the gas introducing pipe 24 and the tubular member 34, as shown with a dot-dash line in FIG. 1**.

When the main chamber 30M thus divided substantially into the first region on the subchamber side and the second region on the gas injecting opening side is charged with the liquefied gas, the case member 22 is caused to assume such a posture that the gas injecting opening 21 is positioned above the main chamber 30M and the gas introducing structure constituted with the gas introducing pipe 24 and the tubular member 34 extends vertically downward from the gas injecting opening 21, so that a liquefied gas storing portion having a bottom formed with the partition member 31 is provided in the first region on the subchamber side of the main chamber 30M. With this posture of the case member 22, the liquefied gas is injected into the main chamber 30M through the gas introducing structure from the gas injecting opening 21 to be impounded in the liquefied gas storing portion.

The injection of the liquefied gas into the main chamber 30M is stopped when the liquefied gas impounded in the liquefied gas storing portion provided in the first region on the subchamber side of the main chamber 30M has its surface which reaches the end portion 34*a* of the tubular member 34 so that the end portion 24*a* of the gas introducing pipe 24 is closed by the liquefied gas impounded in the liquefied gas storing portion. Accordingly, the maximum quantity of liquefied gas impounded in the main chamber 30M is determined in accordance with the space capacity of the first region on the subchamber side of the main chamber 30M. The space capacity of the first region on the subchamber side of the main chamber 30M and the diameter and position of the end portion 33*a* of the gas passage forming portion 33 extends from the partition member 31 into the main chamber 30M are so selected that the end portion 33*a* of the gas passage forming portion 33 does not come into contact with the liquefied gas impounded in the liquefied gas storing portion which is provided in the first region on the subchamber side of the main chamber 30M in response to the posture of the case member 22.

Figure 2:
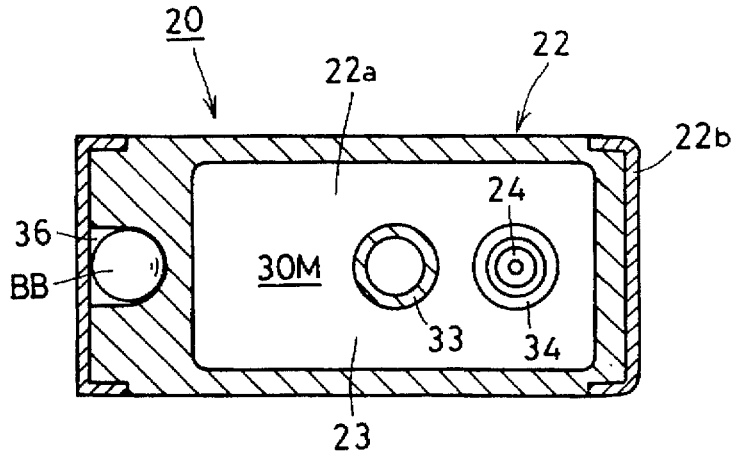
FIG. 2 is a schematic cross sectional view used for explaining the construction of the embodiment shown in FIG. 1.

Namely, as shown in FIG. 1, the end portion 33*a* of the gas passage forming portion 33 is placed to face to the bottom portion 22*a* of the case member 22 at a selected position where is closer to the bottom portion 22*a* of the case member 22 than a position where the end portion 34*a* of the tubular member 34 is placed and more distant from the partition member 31 than the position where the end portion 34*a* of the tubular member 34 is placed. Further, as shown in FIG. 2, the gas passage forming portion 33 extends linearly from the partition member 31 is so positioned as to be distant from the gas introducing structure constituted with the gas introducing pipe 24 and the tubular member 34 and to have an imaginary center line thereof substantially coincident with the imaginary center line of the main chamber 30M. In such a manner as mentioned above, the position and length of the gas passage forming portion 33 extending linearly from the partition member 31 are determined.

The space capacity of the first region on the subchamber side of the main chamber 30M, which has its depth corresponding to a distance from the end portion 34*a* of the tubular member 34 constituting the gas introducing structure to the partition member 31, is selected to be less than fifty percent, for example, twenty to thirty percent of the whole capacity of the main chamber 30M. With such an arrangement, even under a condition wherein the case member 22 is caused to assume such a posture that the liquefied gas storing portion having the bottom formed with the partition member 31 is provided in the main chamber 30M, the end portion 33*a* of the gas passage forming portion 33 does not come into contact with the liquefied gas which is impounded at the quantity corresponding to the space capacity of the first region on the subchamber side of the main chamber 30M in the liquefied gas storing portion.

Further, the diameter of the end portion 33*a* of the gas passage forming portion 33 is so selected that the end portion 33*a* of the gas passage forming portion 33 does not come into contact with the liquefied gas which is impounded at the quantity corresponding to the space capacity of the first region on the subchamber side of the main chamber 30M in the liquefied gas storing portion even under a condition wherein the case member 22 is caused to assume such a posture that the surface of the liquefied gas extends in almost parallel with the imaginary center line of the main chamber 30M.

The gas discharging passage 26 comprises a lower gas passage 26*a* extending from the subchamber 30S, an upper gas passage 26*b* formed in the upper end portion of the case member 22, and a connecting gas passage 26*c* through which the lower gas passage 26*a* and the upper gas passage 26*b* can be connected with each other and in which the control valve structure 27 is put to be movable. The upper gas passage 26*b* constitutes a connecting portion to be connected with the movable member which is provided at the back of the barrel 2 in the body 10 of the model gun.

The control valve structure 27 put in the connecting gas passage 26*c* has a valve portion 27*a* operative to move for making the connecting gas passage 26*c* open and closed selectively. The valve portion 27*a* is pushed by a coil spring 39 toward a position for closing the connecting gas passage 26*c*. When the valve portion 27*a* is positioned in accordance with the elastic force by the coil spring 39 for closing the connecting gas passage 26*c*, the lock lever 35 which is forced upward by a coil spring 40 is pushed down by a portion of the control valve structure 27 against the elastic force by the coil spring 40. Then, when the valve portion 27*a* is moved against the elastic force by the coil spring 39, the lock lever 35 is released from pushing down by the portion of the control valve structure 27 and moved upward by the coil spring 40 to maintain the valve portion 27*a* at the position for closing the connecting gas passage 26*c*.

When the case member 22 of the gas pressure accumulating and supplying device 20 which is constituted with one of embodiment of gas pressure accumulating and supplying device for use in model guns according to the present invention is held detachably in the grip 8 provided in the body 10 of the model gun, as shown in FIG. 1, the upper end portion of the magazine 36 is positioned in the vicinity of the bullet holding chamber provided just at the back of the barrel 2 and covered by the movable member provided at the back of the barrel 2. The sham bullets BB contained in the magazine 36 are pushed down against the pushing member 37 and the coil spring 38. The valve portion 27*a*provided on the control valve structure 27 is put at the position for closing the connecting gas passage 26*c* and therefore the gas discharging passage 26 is shut off.

Under a condition wherein the liquefied gas is impounded in the main chamber 30M in the pressure accumulating chamber 23 provided in the gas pressure accumulating and supplying device 20, when the slider 3 is moved back and forward along the barrel 2 together with the movable member provided at the back of the barrel 2, the hammer 6 is moved to rotate to a predetermined rotating position .with the movements of the slider 3. During the back movement of the slider 3, the movable member is moved back so as to open the upper end portion of the magazine 36 and one of the sham bullets BB at the top in the magazine 36 is pushed up into the upper end portion of the magazine 36 to be held therein by the coil spring 38. Then, during the forward movement of the slider 3, the movable member is moved forward so as to cause the front portion thereof to come into the upper end portion of the magazine 36 and to carry the sham bullet BB in the upper end portion of the magazine 36 to the bullet holding chamber provided just at the back of the barrel 2.

When the trigger 1 is pulled after the sham bullet BB has been supplied to the bullet holding chamber provided just at the back of the barrel 2, the hammer 6 is moved to rotate for moving the valve portion 27*a* provided on the control valve structure 27 so as to open the connecting gas passage 26*c*. The gas pressure from the pressure accumulating chamber 23 is supplied through the gas discharging passage 26 to the movable member provided at the back of the barrel 2 and the gas pressure obtained through the gas control structure provided in the movable member acts on the sham bullet BB put in the bullet holding chamber so as to shoot the sham bullet BB from the bullet holding chamber. Then, after the sham bullet BB has been shot, the slider 3 is moved back and forward again along the barrel 2 together with the movable member and a new sham bullet BB from the magazine 36 is supplied to the bullet holding chamber provided just at the back of the barrel 2.

When the main chamber 30M in the gas pressure accumulating and supplying device 20 which has the case member 22 held detachably in the grip 8 is charged with the liquefied gas, the body 10 of the model gun is handled to cause the gas pressure accumulating and supplying device 20 to assume such a posture that the gas injecting opening 21 is positioned above the main chamber 30M and the liquefied gas storing portion having the bottom thereof formed with the partition member 31 is provided in the first chamber on the subchamber side of the main chamber 30M. Accordingly, the gas passage forming portion 33 extending from the partition member 31 into the main chamber 30M and having the end portion 33*a* thereof placed at the selected position where is closer to the bottom portion 22*a* of the case member 22 than a position where the end portion 34*a* of the tubular member 34 is placed is so positioned that the end portion 33*a* is placed to be higher than the end portion 34*a* of the tubular member 34, as shown in FIG. 3, and the liquefied gas is injected into the main chamber 30M through the gas introducing portion from the gas injecting opening.

Figure 3:
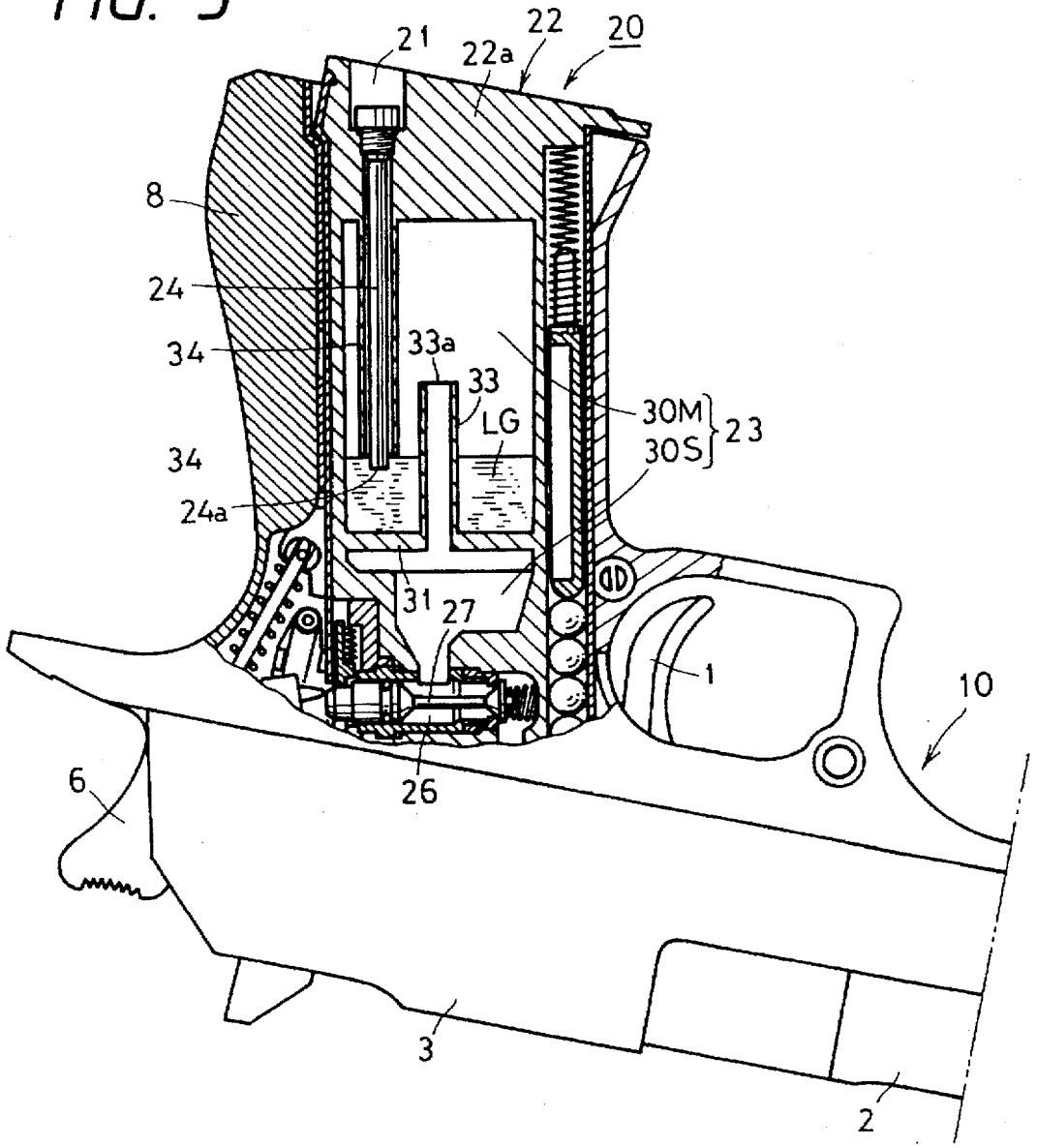
FIGS. 3, 4 and 5 are schematic cross sectional views used for explaining conditions in each of which the embodiment shown in FIG. 1 assumes a different posture.

In the pressure accumulating chamber 23 in which the main chamber 30M is provided to be charged with liquefied gas, as shown in FIG. 3, the liquefied gas LG injected through the gas introducing structure constituted with the gas introducing pipe 24 and the tubular member 34 into the main chamber 30M is prevented from flowing into the subchamber 30S by the partition member 31 and impounded in the first region on the subchamber side of the main chamber 30M to evaporate naturally. Under such a condition, the end portion 33*a* of the gas passage forming portion 33 extending from the partition member 31 into the main chamber 30M is positioned above the liquefied gas LG so as not to come into contact with the liquefied gas LG. Consequently, only gas obtained by evaporation of the liquefied gas LG in the main chamber 30M is led through the gas passage forming portion 33 to the subchamber 30S. The subchamber 30S to which the gas from the main chamber 30M is introduced has a space capacity sufficient for storing the quantity of gas necessary for one shot of the sham bullet in the body 10 of the model gun.

When the model gun in which the case member 22 of the gas pressure accumulating and supplying device 20 is held detachably in the grip 8 is handled to cause the case member 22 of the gas pressure accumulating and supplying device 20 to assume such a posture that the gas injecting opening 21 is positioned below the main chamber 30M, the liquefied gas LG impounded in the first region on the subchamber side of the main chamber 30M moves into the second region on the gas injecting opening side of the main chamber 30M and is impounded in the liquefied gas storing portion provided with a bottom formed with the bottom portion 22*a* of the case member 22 in the second region on the gas injecting opening side of the main chamber 30M. In the pressure accumulating chamber 23 in which the liquefied gas LG is thus impounded in the liquefied gas storing portion provided in the second region on the gas injecting opening side of the main chamber 30M, the gas passage forming portion 33 extends toward the bottom portion 22*a* of the case member 22 from the partition member 31 positioned above the main chamber 30M to have the end portion 33*a* thereof facing to the bottom portion 22*a* of the case member 22 at a position distant from the bottom portion 22*a* of the case member 22 by a distance larger than the distance corresponding to the depth of the first region on the subchamber side of the main chamber 30M. Therefore, the end portion 33*a* of the gas passage forming portion 33 does not come into contact with the liquefied gas LG so that only gas obtained by evaporation of the liquefied gas LG in the main chamber 30M is led through the gas passage forming portion 33 to the subchamber 30S even under a condition wherein the liquefied gas LG is impounded at its maximum in the liquefied gas storing portion provided in the second region on the gas injecting opening side of the main chamber 30M, as shown with a dot-dash line in FIG. 1.

The partition member 31 and the gas passage forming portion 33, which prevent the liquefied gas impounded in the main chamber 30M from flowing into the subchamber 30S under both the condition wherein the gas injecting opening 21 is positioned above the main chamber 30M and the condition wherein the gas injecting opening 21 is positioned below the main chamber 30M as described above, are put in function to prevent the liquefied gas impounded in the main chamber 30M from flowing into the subchamber 30S also under a condition wherein the case member 22 which is held detachably in the grip 8 is caused to assume any posture other than the posture by which the gas injecting opening 21 is positioned above or below the main chamber 30M in accordance with a certain handling of the model gun.

Figure 4:
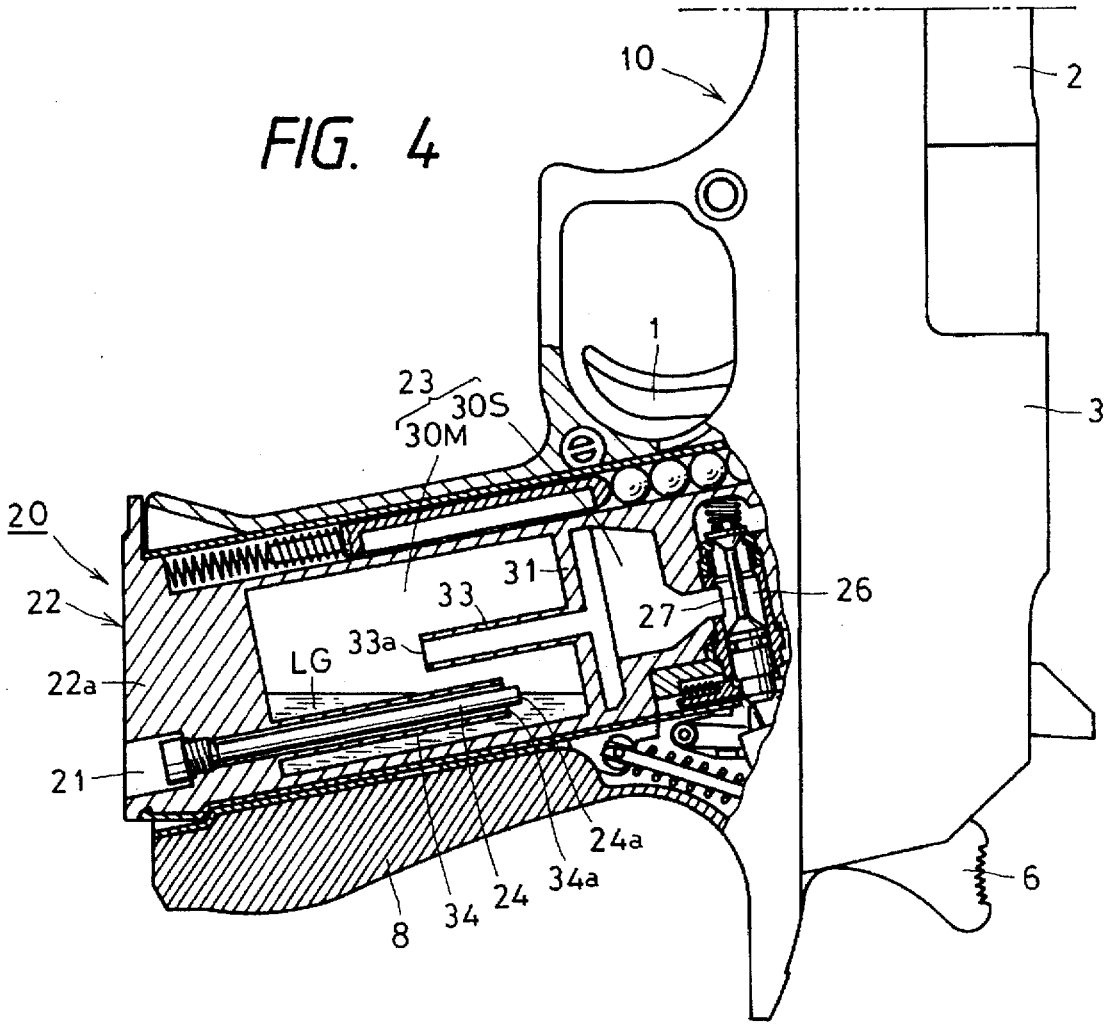
Figure 5:
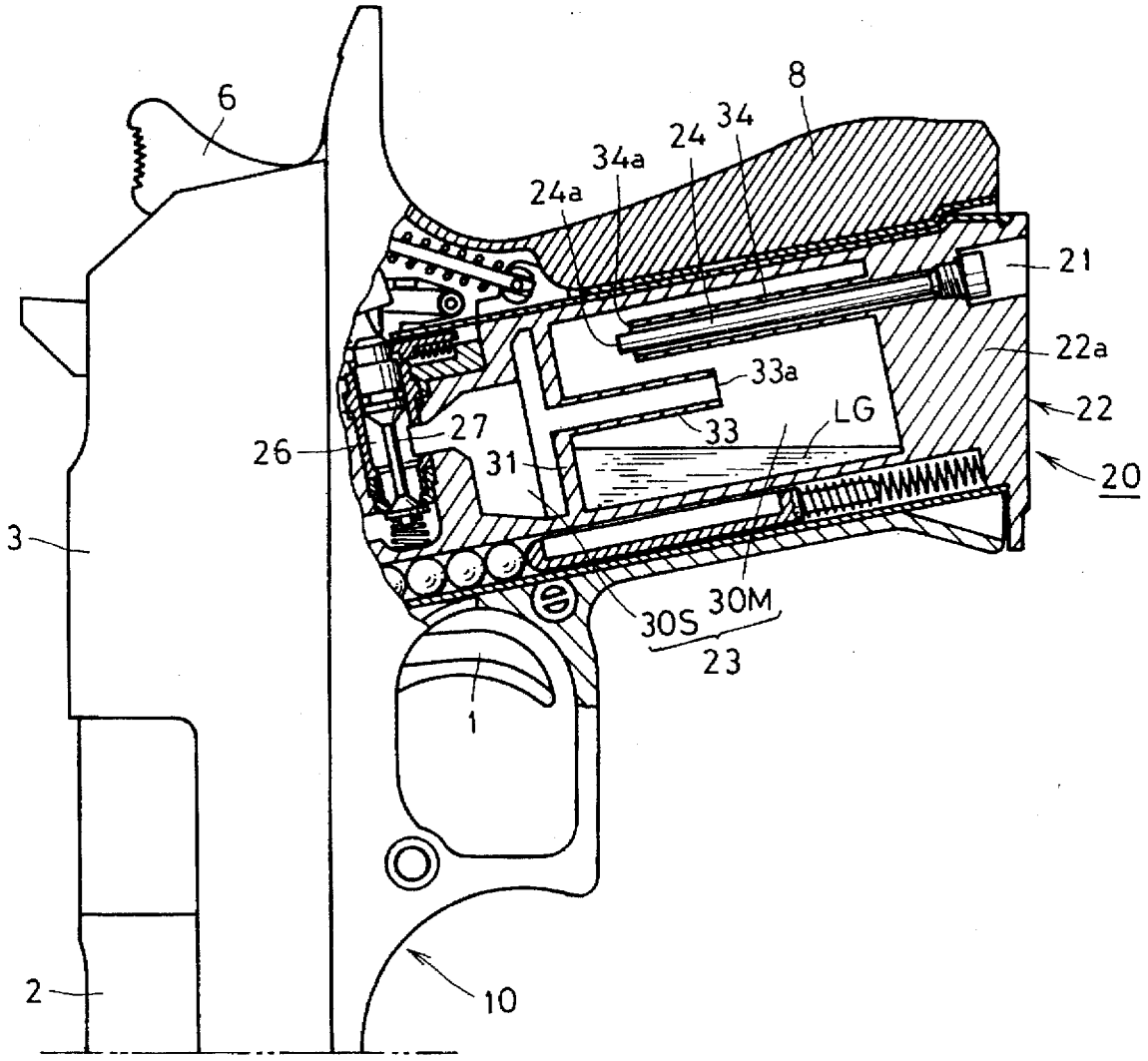

As described above, since the gas passage forming portion 33 extends linearly from the partition member 31 is so positioned as to have an imaginary center line thereof almost coincident with the imaginary center line of the main chamber 30M and the diameter of the end portion 33*a* of the gas passage forming portion 33 is so selected that the end portion 33*a* of the gas passage forming portion 33 does not come into contact with the liquefied gas LG which is impounded in the main chamber 30M even under the condition wherein the case member 22 is caused to assume such a posture that the surface of the liquefied gas extends in almost parallel with the imaginary center line of the main chamber 30M, the end portion 33*a* of the gas passage forming portion 33 does not come into contact with the liquefied gas LG which is impounded in the main chamber 30M also under both a condition wherein the model gun is handled to cause the case member 22 to assume such a slant posture that both of the end portion 24*a* of the gas introducing pipe 24 and the end portion 34*a* of the tubular member 34 are positioned above the gas injecting opening 21 and the liquefied gas storing portion in which the liquefied gas LG can be impounded at the quantity corresponding to the space capacity of the first region on the subchamber side of the main chamber 30M is provided around the tubular member 34 in the main chamber 30M, as shown in FIG. 4, and a condition wherein the model gun is handled to cause the case member 22 to assume such another slant posture that both of the end portion 24*a* of the gas introducing pipe 24 and the end portion 34*a* of the tubular member 34 are positioned below the gas injecting opening 21 and the liquefied gas storing portion in which the liquefied gas LG can be impounded at the quantity corresponding to the space capacity of the first region on the subchamber side of the main chamber 30M is provided below the tubular member 34 in the main chamber 30M, as shown in FIG. 5. Further, the partition member 31 is put in function to prevent the liquefied gas LG impounded in the main chamber 30M from flowing into the subchamber 30S regardless of the posture of the case member 22.

Accordingly, only gas obtained by evaporation of the liquefied gas LG in the main chamber 30M is introduced through the gas passage forming portion 33 into the subchamber 30S from the main chamber 30M even under a condition wherein the case member 22 of the gas pressure accumulating and supplying device 20 which is held detachably in the grip 8 is varied in its posture and the liquefied gas LG impounded on the main chamber 30M moves actively in accordance with the handling of the model gun. As a result, in the gas pressure accumulating and supplying device 20, a condition wherein the liquefied gas injected into the main chamber 30M through the gas introducing structure constituted with the gas introducing pipe 24 and the tubular member 34 from the gas injection opening 21 leaks out the main chamber 30M to the gas discharging passage 26 through the gas passage forming portion 33 and the subchamber 30S is surely prevented from arising, so that gas pressure discharged from the main chamber 30M can be kept at an appropriate value over a relatively long period after the pressure accumulating chamber 23 is charged at its maximum with the liquefied gas.

Further, since the gas passage forming portion 33 is connected through the subchamber 30S which is formed with the partition member 31 to be supplied with the gas from the main chamber 30M to the gas discharging passage 26, the gas from the main chamber 30M is supplied smoothly without raising friction resistance to the gas discharging passage 26.

Besides, since the subchamber 30S to which the gas from the main chamber 30M is introduced has the space capacity sufficient for storing the quantity of gas necessary for one shot of the sham bullet in the body 10 of the model gun, the gus pressure in the subchamber 30S is reduced when the sham bullet is shot in the period in which the connecting gas passage **26*c* is made open by the movement of the valve portion 27*a* provided on the control valve structure 27, and therefore the gas from the main chamber 30M is supplied to the subchamber 30S is which the gus pressure has been reduced just after the connecting gas passage 26*c* has been closed. Consequently, even if the liquefied gas flows into the subchamber 30S from the main chamber 30M when the gas from the main chamber 30M is supplied to the subchamber 30S in which the gus pressure has been reduced, the liquefied gas in the subchamber 30S is prevented from leaking out to the connecting gas passage 26*c* and evaporates in the subchamber 30S** until a subsequent shot of the sham bullet is done.

What is claimed is:

1. A gas pressure accumulating and supplying device for use in model guns, which comprises:

a pressure accumulating chamber provided in a case member, a gas injecting opening provided on a bottom portion of the case member, a gas introducing structure extending from the gas injecting opening into the pressure accumulating chamber, a gas discharging passage for opening into the pressure accumulating chamber in a direction toward the bottom portion of the case member, a control valve structure provided in the gas discharging passage for controlling supply of gas pressure from the pressure accumulating chamber, a partition member provided in the pressure accumulating chamber for partitioning the pressure accumulating chamber into a main chamber structure from the gas injecting opening, and a subchamber positioned between the main chamber and the gas discharging passage, and a gas passage forming portion extending from the partition member into the main chamber for forming a gas passage connecting with the subchamber and having an end portion reaching a position closer to the bottom portion of the case member than an end portion of the gas introducing structure.

2. A gas pressure accumulating and supplying device for use in model guns according to claim 1, wherein said end portion of the gas passage forming portion is so selected in diameter and position as not to come into contact with the liquefied gas impounded in a liquefied gas storing portion provided in the main chamber in accordance with a posture of the case member.

3. A gas pressure accumulating and supplying device for use in model guns according to claim 1, wherein said end portion of the gas passage forming portion is so positioned as to have an imaginary center line substantially coincident with an imaginary center line of the main chamber.

4. A gas pressure accumulating and supplying device for use in model guns according to claim 1, wherein a distance from the end portion of the gas passage forming portion to the bottom portion of the case member is not shorter than a distance from the end portion of the gas introducing structure to the partition member.

5. A gas pressure accumulating and supplying device for use in model guns according to claim 1, wherein said main chamber provided in the pressure accumulating chamber is divided substantially into a first region on the subchamber side of the main chamber and a second region on the gas injecting opening side of the main chamber by a plane which includes the end portion of the gas introducing structure and is perpendicular to an imaginary center line of the gas introducing structure and a space capacity of said first region on the subchamber side of the main chamber is selected to be less than fifty percent of the whole space capacity of the main chamber.

6. A gas pressure accumulating and supplying device for use in model guns according to claim 1, wherein said case member is held in a grip provided in a body of a model gun which uses gas pressure for shooting a sham bullet so as to form said model gun together with said body.

* * * * *